US009184015B2

(12) United States Patent
Dhinojwala et al.

(10) Patent No.: US 9,184,015 B2
(45) Date of Patent: Nov. 10, 2015

(54) CARBON NANOTUBE BASED FIELD EMISSION DEVICES AND METHODS

(75) Inventors: Ali Dhinojwala, Akron, OH (US); Sunny Sethi, Copley, OH (US)

(73) Assignee: The University of Akron, Akron, OH (US)

( * ) Notice: Subject to any disclaimer, the term of this patent is extended or adjusted under 35 U.S.C. 154(b) by 635 days.

(21) Appl. No.: 13/502,854

(22) PCT Filed: Sep. 20, 2010

(86) PCT No.: PCT/US2010/049499

§ 371 (c)(1), (2), (4) Date: May 30, 2012

(87) PCT Pub. No.: WO2011/035246

PCT Pub. Date: Mar. 24, 2011

(65) Prior Publication Data

US 2012/0235097 A1 Sep. 20, 2012

Related U.S. Application Data

(63) Continuation-in-part of application No. 11/428,185, filed on Jun. 30, 2006, now Pat. No. 7,927,666.

(60) Provisional application No. 61/243,612, filed on Sep. 18, 2009.

(51) Int. Cl.

| | |
|---|---|
| ***H01B 1/04*** | (2006.01) |
| ***H01J 1/304*** | (2006.01) |
| ***H01J 9/02*** | (2006.01) |
| ***H01J 31/12*** | (2006.01) |

(52) U.S. Cl.

CPC ..... *H01J 1/304* (2013.01); *H01J 9/025* (2013.01); *H01J 31/123* (2013.01); *H01J 2201/30469* (2013.01); *H01J 2329/0455* (2013.01); *Y10T 156/10* (2015.01)

(58) Field of Classification Search

None

See application file for complete search history.

(56) References Cited

U.S. PATENT DOCUMENTS

| | | | |
|---|---|---|---|
| 2007/0103048 | A1 | 5/2007 | Liu et al. |
| 2007/0160758 | A1 | 7/2007 | Roach |
| 2007/0166470 | A1 | 7/2007 | Kashiwagi |

(Continued)

FOREIGN PATENT DOCUMENTS

| | | | |
|---|---|---|---|
| WO | 2007004758 | A1 | 1/2007 |
| WO | 2008118452 | A1 | 10/2008 |

OTHER PUBLICATIONS

Extended European Search Report Issued Feb. 13, 2013.

*Primary Examiner* — Erma Cameron

(74) *Attorney, Agent, or Firm* — Renner Kenner Greive Bobak Taylor & Weber

(57) ABSTRACT

A method of fabricating a cathodic portion of a field emission display includes the steps of producing an array of substantially parallel carbon nanotubes attached at one end to a substantially planar substrate. Then, embedding the nanotubes in a polymer matrix that extends to a plane of attachment of the nanotubes to the planar substrate, wherein the polymer matrix allows an end of the nanotubes distal from the ends attached to the planar substrate, uncovered by the polymer matrix in order to allow electrical contact with each other and with an attached conductor. Next, detaching the array from the planar substrate, thus producing a surface having the formerly attached ends of the nanotubes substantially in a plane, and then attaching the conductor to the array of nanotube ends, uncovered by the polymer matrix and distal to the plane.

6 Claims, 8 Drawing Sheets

(56) References Cited

U.S. PATENT DOCUMENTS

2008/0145616 A1* 6/2008 Gharib et al. ..... 428/156
2008/0203886 A1 8/2008 Takai et al.
2008/0280137 A1 11/2008 Ajayan et al.
2008/0293321 A1 11/2008 Kang et al.

* cited by examiner

CARBON NANOTUBE BASED FIELD EMISSION DEVICES AND METHODS

CROSS REFERENCE TO RELATED APPLICATION

The present application is being filed with the U.S. Receiving Office as a PCT application claiming priority from and any other benefit of U.S. Provisional Patent Application Ser. No. 61/243,612 filed Sep. 18, 2009. The present application also is a Continuation-in-Part application of U.S. patent application Ser. No. 11/428,185 filed on Jun. 30, 2006, the entire disclosure of which is hereby incorporated by reference.

TECHNICAL FIELD

Certain embodiments of the present invention relate to carbon nanotubes. More particularly, certain embodiments of the present invention relate to carbon nanotubes based field emission devices.

BACKGROUND

There have been efforts to produce field emission displays (FED), which provide a flat panel display using large-area field electron sources to provide electrons that strike colored phosphor to produce a color image. FED's combine the advantages of CRTs, such as providing high contrast levels and very fast response times, while providing the advantages of flat panel technologies. They also offer the possibility of requiring less power, about half that of an LCD system for example. An FED display operates similar to a conventional cathode ray tube (CRT) with an electron gun that uses high voltage to accelerate electrons which in turn excite the phosphors, but instead of a single electron gun, a FED display contains a grid of individual nanoscopic electron guns. In the past, an FED screen was constructed by laying down a series of metal stripes onto a glass plate to form a series of cathode lines. A series of rows of switching gates is formed at right angles to the cathode lines, forming an addressable grid. At the intersection of each row and column a small patch of emitters are deposited. The metal grid is laid on top of the switching gates to complete the gun structure. A high voltage-gradient field is created between the emitters and a metal mesh suspended above them, pulling electrons off the tips of the emitters. This is a highly non-linear process and small changes in voltage will quickly cause the number of emitted electrons to saturate. The grid can be individually addressed but only the emitters located at the crossing points of the powered cathode and gate lines will have enough power to produce a visible spot, and any power leaks to surrounding elements will not be visible. The grid voltage sends the electrons flowing into the open area between the emitters at the back and the screen at the front of the display, where a second accelerating voltage additionally accelerates them towards the screen, giving them enough energy to light the phosphors. Since the electrons from any single emitter are fired toward a single sub-pixel, scanning electromagnets are not needed.

Although shown to be a viable display technology, past efforts have not produced displays which would allow use in commercial products. In FED devices, strong electric field and high temperature can cause electron emission from a material. In contrast to conduction current, emission current may be low, but the energy of electrons is much higher in emission than in conduction, thus making them useful for a number of applications, like displays or electron microscopy.

Emission from flat metal electrodes require very high voltages at room temperatures. On the other hand, sharp needle-like cathodes require lower voltages due to enhancement of electric fields at the tip of an electrode. An example of a sharp material for electron emission are carbon nanotubes. Carbon nanotubes have unique electrical and mechanical properties. Emission from a single carbon nanotube starts at a much lower voltage than a corresponding metal wire of similar dimensions. It has been suggested that the carbon nanotubes have atomically sharp wires dangling from its ends or tips. As compared to a single carbon nanotube, an array of carbon nanotubes' threshold voltage is much higher and its emission current decreased by a large amount.

There have been efforts to use carbon nanotubes (CNT) in such displays or other FED applications. For example, companies like Motorola, Samsung and Cendescent have shown small VGA FED type prototypes in various technical meetings (e.g. Motorola's "Nano-emissive display, 5" diagonal and 3.3 mm thick). However, there are many challenges to achieve uniform field emission from a large area of aligned CNT. In prior efforts, the synthesis of large area aligned CNT with uniform height was not achievable. In such efforts, longer CNT are closer to the anode than the smaller CNT. Therefore emission current from different sections of CNT cathode may be different. Additionally, stray carbon nanotubes may get pulled out of the array forming a resistive contact with the anode, which causes short-circuiting. An additional limitation relates to a screening effect. It has been suggested that the threshold voltage increased due to a screening effect. The screening effect can be thought of as a reduction in an effective electric field at a tip of a needle when other needles with similar potentials are placed within its proximity. Current density achieved from macroscopic samples of carbon nanotubes are of the order of 1 $mA/cm^2$. The emission current from single carbon nanotube of 10 nm diameter was 1 mA. This means that only one thousand carbon nanotubes are effectively emitting from an area of 1 $cm^2$, as compared to $10^8$ carbon nanotubes present. Therefore, a need exists for a field emission display that is more efficient. Due to proximity of neighboring CNTs, electron emission from an array of CNT occurs at much higher voltages as compared to single CNT. This is disadvantageous because higher voltages are then required for desired emission from a CNT array to produce the pixel or sub-pixel brightness or other characteristics as desired. Efforts to overcome these challenges have resulted in different techniques being used, such as like dispersing CNT with an organic binder or screen printing of the CNT array. These methods can create uniform coatings of CNT. However, using these techniques, aligned CNT cathodes cannot be generated. Therefore, a need exists for a field emission display that is more efficient.

Further limitations and disadvantages of conventional, traditional, and proposed approaches will become apparent to one of skill in the art, through comparison of such systems and methods with the present invention as set forth in the remainder of the present application with reference to the drawings.

SUMMARY OF THE INVENTION

An embodiment of the present invention comprises a method of fabricating a cathodic portion of a field emission display includes the steps of producing an array of substantially parallel carbon nanotubes attached at one end to a substantially planar substrate. Then, embedding the nanotubes in a polymer matrix that extends to a plane of attachment of the nanotubes to the planar substrate, wherein the polymer matrix allows an end of the nanotubes distal from the ends attached to the planar substrate, uncovered by the polymer matrix in order to allow electrical contact with each other and with an attached conductor. Next, detaching the array from the planar substrate, thus producing a surface having the formerly attached ends of the nanotubes substantially in a plane, and then attaching the conductor to the array of nanotube ends, uncovered by the polymer matrix and distal to the plane.

Another embodiment of the present invention comprises a field emission device that includes a polymer matrix, wherein the polymer matrix is polysiloxane, and at least one carbon nanotube. The at least one carbon nanotube is substantially parallel to one another. Moreover, the at least one carbon nanotube is attached to the polymer matrix and an unattached portion of the at least one carbon nanotube is substantially level with one another.

In a further aspect, the invention describes a system and method for providing a system and method for emission from a CNT array at low threshold voltages, wherein alignment of the CNT array in a desired manner provides such capabilities. In the invention, the system and method utilize the synthesis of an aligned array of CNT with uniform height using a composite structure formed of aligned CNT and one or more polymers. The system and method provides a uniform CNT array. Incorporation of polymer in between CNTs also results in reducing screening effect, thus allowing lower threshold voltages (for example O.SV 1 micron). There is also provided a process for forming large area aligned carbon nanotube (CNT) structures with substantially uniform height. These aligned CNT structures may be used as a cathode for field emission displays (FED). FED have many advantages over current display technologies based on LCD and plasma for example. As compared to other technologies for creating large area CNT cathodes for FED based on CNT dispersed in organic binders, the aligned CNT structures of the present invention have higher electron emission efficiency than dispersed CNTs. To create a large area of aligned CNT with substantially uniform height, a composite structure of CNT and polymers is formed such that substantially uniform electron emission on large area can be achieved.

These and other features of the claimed invention, as well as details of illustrated embodiments thereof, will be more fully understood from the following description and drawings.

DETAILED DESCRIPTION

Figure 1:
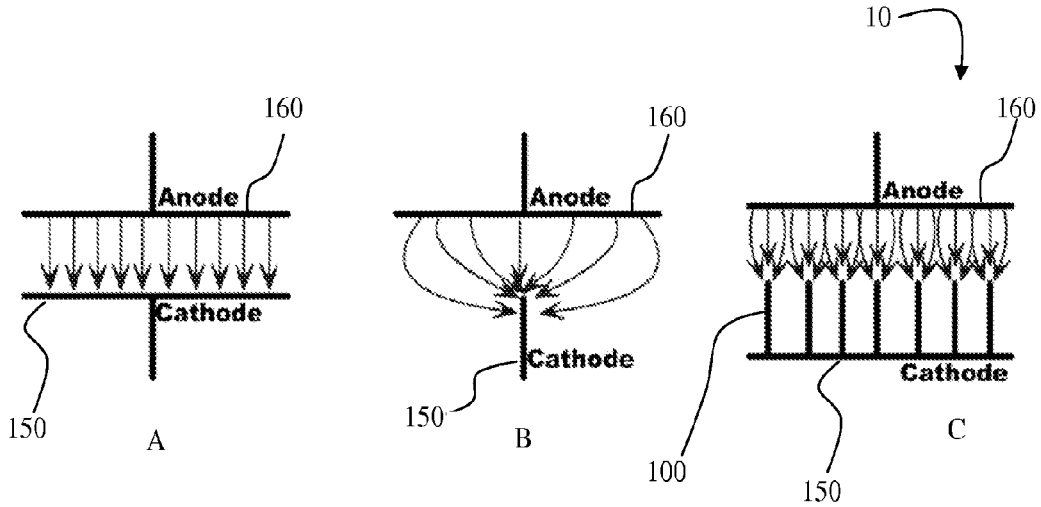
FIG. 1 illustrates a schematic of field lines, wherein (A) shows electric field lines for parallel plate geometry, (B) shows geometry of field lines when cathode is pointed needle like. Electric field lines are more concentrated at the tip pf cathode, and (C) shows when a lot of needle like cathodes are present.

FIG. 1 illustrates a schematic of field lines, wherein (A) shows electric field lines for parallel plate geometry, (B) shows geometry of field lines when cathode is pointed needle like. Electric field lines are more concentrated at the tip pf cathode, and (C) shows when a lot of needle like cathodes are present. FIG. 1(C) also shows the field lines being divided at the tips of all the cathodes, thus reducing the enhancing effect. In an embodiment of the present invention, rigid and flexible field emission devices and/or systems 10 may be based on vertically aligned and non-aligned carbon nanotubes (CNT) 100. Moreover, the field emission devices 10 may be patterned or non-patterned vertically aligned carbon nanotubes 100, which may offer certain advantages.

Embedding the aligned nanotubes 100 in a polymer matrix 120, a polymer with a suitable viscosity may be desired. In such a case, the viscosity should be such that the polymer network is of a tackiness nature. The tackiness nature will allow ends of the carbon nanotubes 100 to penetrate in the network. However, the polymer should be high enough so that the polymer chains do not cover the top of the carbon nanotube chains. The embedding process involves having the polymer in a partial liquid state prior to embedding and then in a solid state thereafter. In this way, there is formed a carbon nanotube array which is not completely submerged in a polymer matrix. In this manner, more than only a few strands of carbon nanotubes are active and the resulting structure will have high efficiency since many carbon nanotubes are active. The structures are also therefore suitable for use in display technology, where uniform emission over large area is required. The process or the invention will allow production of large areas of active carbon nanotube ends for field emission. The process of the invention also provides for and allows robust structures to be formed, where individual carbon nanotubes are not pulled out of the structures upon application of voltage or other deterioration of the structure during use. For example, multiple hysteresis I-V cycles have been measured on the structures to yield uniform results.

An example of an embedding process of the carbon nanotubes 100 includes having a prepolymer, e.g. poly (di-methyl-siloxane), and then cross-linking after embedding the carbon nanotubes 100 into a matrix. Then, a monomer, e.g. cyanoacrylate, embeds the carbon nanotubes 100 in the pre-polymer film, which then lets the pre-polymer polymerize to form a solid polymer. A next step may include dissolving the solid polymer with a solvent to form a viscous solution. Then, coating the viscous solution on a rigid substrate, which embeds the carbon nanotubes 100 in the rigid substrate then and letting the solvent evaporate. An example of this is shown by poly (methyl-meth-acrylate) in toluene. Chemical reactions between the two components will then yield a solid substrate, e.g. epoxy resins. Softening of a thermoplastic by heating the thermoplastic above its glass transition temperature and embedding nanotubes in the softened polymer matrix 120 followed by cooling of the system.

Figure 2:
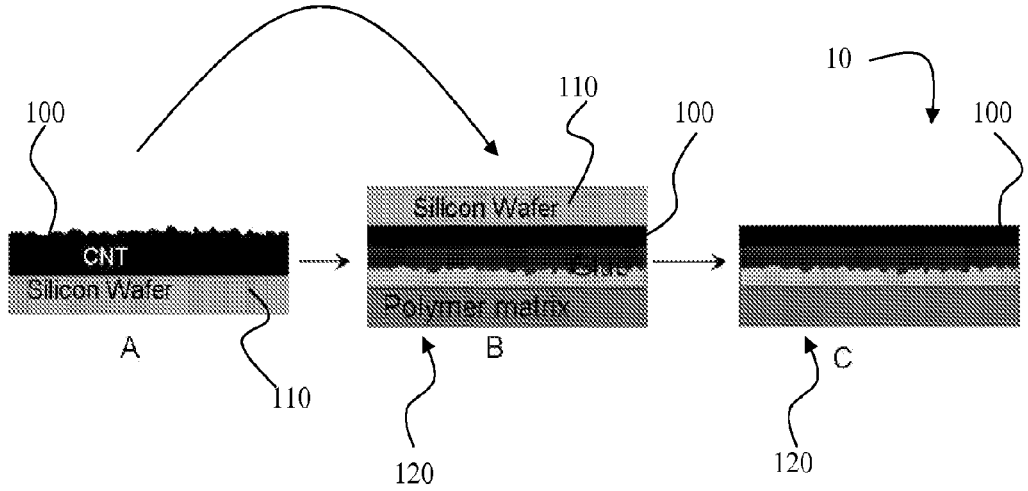
FIG. 2 illustrates carbon nanotubes being transferred onto a polymeric matrix so that the uniform surface is exposed on the top, wherein (A) carbon nanotubes (CNTs) are grown on a silicon wafer, (B) the grown wafer is then inverted onto a polymeric matrix with an adhesive layer on top of it, and (C) the silicon wafer is then removed and the carbon nanotubes transferred onto the polymer matrix.

With reference to FIG. 2, there is illustrated carbon nanotubes 100 being transferred onto a polymeric matrix 120 so that the uniform surface is exposed on the top, wherein (A) the carbon nanotubes (CNTs) are grown on a silicon wafer 110, (B) the grown wafer is then inverted onto the polymeric matrix 120 with an adhesive layer on top of it, and (C) the silicon wafer 110 is then removed and the carbon nanotubes 100 transferred onto the polymer matrix 120. FIG. 2 demonstrates how transferring the carbon nanotubes 100 into the polymeric matrix 120 helps attain a more uniform upper surface. As the grown carbon nanotubes 100 may not be absolutely uniform with respect to one another. Some areas may have longer nanotubes 100, while other areas may have shorter nanotubes 100. The effect can reduce the efficiency of the whole system 10 because emissions may occur only from a few points, nanotubes 100. The end of the nanotubes 100 facing the silicon wafer 110 has a higher surface uniformity, as shown in FIG. 2.

Figure 5:
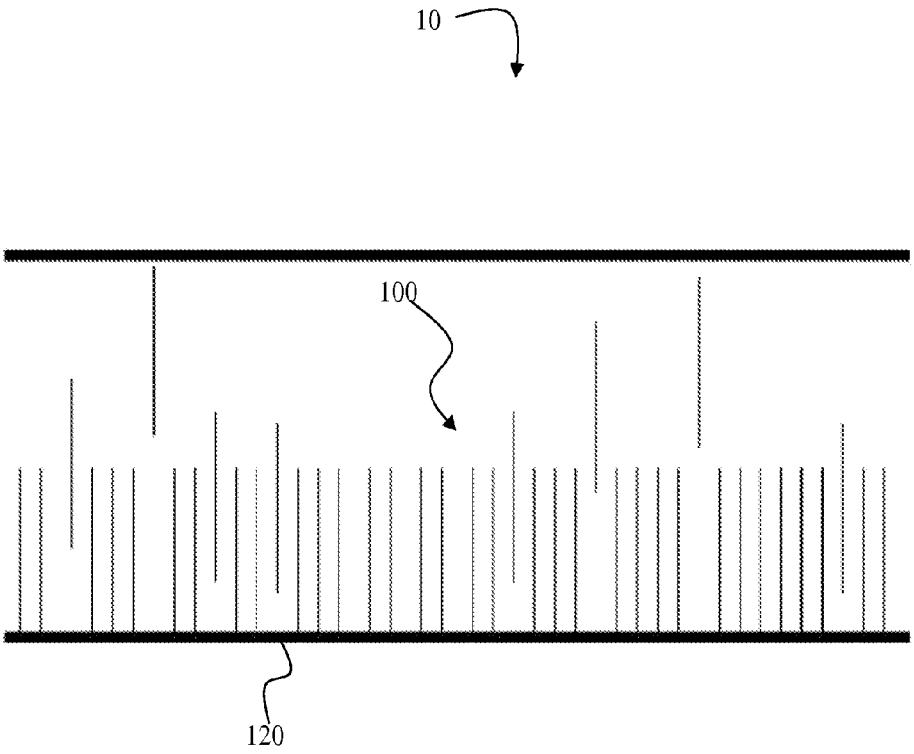
FIG. 5 illustrates carbon nanotubes being pulled off towards an anode under high electric fields.

Embedding carbon nanotubes 100 in the polymeric matrix 120 helps reduce a screening effect, which also keeps emissions occurrences at a lower turn on voltages. Another effect of embedding carbon nanotubes 100 include assisting in counteracting surface roughness and may also yield a more uniform emitting surface, as shown in FIG. 2. Embedding carbon nanotubes 100 in the polymeric matrix 120 also helps prevent pullout of the carbon nanotubes 100 from a base, the polymeric matrix 120, as shown in FIG. 5. In certain instances, in the presence of a high electric field, carbon nanotubes 100 may get pulled towards an anode 60, which may then lead to a short-circuit. By trapping the carbon nanotubes 100 in the polymeric base, the carbon nanotubes 100 would be prevented from being pulled off the base. Moreover, depending on the desired application, the field emission device 10 may be flexible or rigid. The process described above may also create a structure that is super-hydrophobic, which would impart self-cleaning abilities to the whole system.

Figure 3:
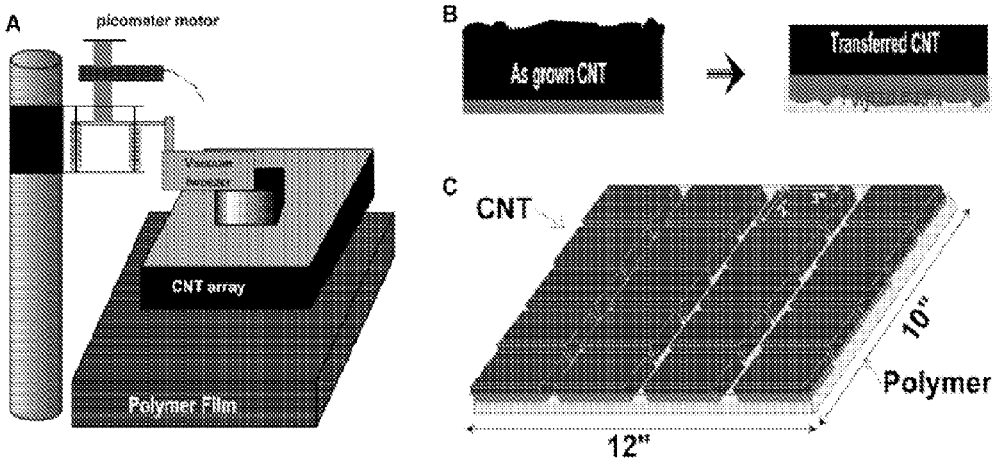
FIG. 3A-3C show an apparatus for forming the FED type of device according to the invention, partially embedding the CNT array into a polymer matrix and CNT arrays in a polymer matrix respectively, according to examples of the invention.

Turning to FIG. 3A, there is shown a schematic sketch of an instrument that may be used for creating uniform arrays of carbon nanotube structures according to aspects of the invention. The instrument may include a picometer motor coupled with a vacuum tweezer arrangement which uses differences in atmospheric pressure to grasp the CNTs or array thereof. Predetermined vacuum tweezer tips may be used to handle the CNT materials in the desired manner. In this example, a CNT array is pressed in the polymer matrix or film such that a predetermined amount (for example 20 microns) of the CNT array is substantially uniformly exposed from the polymer matrix. As seen in FIG. 3B, the array of grown CNT is pressed into the polymer matrix to form a uniform surface of exposed CNT. Transferring carbon nanotubes into the polymeric matrix helps attain a more uniform upper surface. As grown carbon nanotubes may not be absolutely uniform at the surface, with some areas having longer nanotubes than other areas, such an uneven surface would reduce the efficiency of the whole system because emission may be occurring only from a few points. The other end of nanotubes that faces the substrate has a much higher surface uniformity. Carbon nanotubes maybe transferred onto a polymeric matrix in a way that the uniform surface is exposed in the top. The instrument may also counteract unevenness of the aligned carbon nanotube geometry. The instrument controls the pitch of motion and the motor height such that the exposure of the entire CNT array can be controlled. Once the polymer is cross-linked, the CNT array is peeled from the substrate to expose the CNT arrays. This may also facilitate creating large area structures with substantially uniform height of CNT exposure. In this example, it is also noted that a large area of aligned carbon nanotube electrodes can be generated without the need to grow them on large areas. In FIG. 3C, a large area (such as for example 10"×12") may be formed using smaller sized carbon nanotube array (such as for example 2"×3") samples grown on silicon wafer, which may then be formed into larger structures. The methods of producing the CNT arrays and partial embedding into the polymer matrix avoids the possible movement of the individual CNTs upon the application of high electric fields as seen in FIG. 5 by inhibiting movement of any CNT in the polymer matrix once it is fully cross-linked. This in turn avoids an possible short circuiting that could occur if movement of the CNT's were not so inhibited.

Polymeric matrix materials according to the invention may be of any suitable type, wherein polymeric polymer precursors may include monomers, dimers, trimers or the like. Monomers utilized in this invention may generally be selected from the family of vinyl monomers suitable for free radical polymerization under emulsion conditions. Non-limiting examples of suitable vinyl monomers include methacrylates, styrenes, vinyl chlorides, butadienes, isoprenes, and acrylonitriles, polyacrylic and methacrylic esters and any other suitable precursor materials. The matrix polymer may be a polymer of one or more of the following monomers: methyl methacrylate (MMA), other lower alkyl methacrylates (e.g. ethyl methacrylate, propyl methacrylate, isopropyl methacrylate, butyl methacrylate, 2-ethylhexyl methacrylate, etc., as an example. A starting monomer formulation may also include one or more polymerization initiators. These include, for example, benzoyl peroxide, lauryl peroxide, azobis (isobutyronitrile), 2,2'-azobis (2,4-dimethyl-4 methoxypropionitrile), and 2,2'-azobis (2-methylpropionitrile) or other suitable initiator materials. These are used in small amounts which are well known in the art. Any initiator that is suitable for free radical polymerization can be considered according to the invention. Further, the polymer matrix may also be modified using nanofillers as an example. Nanofillers are fillers having at least one dimension in the nanoscale (1-999 nm). Suitable fillers may include, without limitation, clay minerals, fibers, micro-spheres, and layered silicates. Such nanofillers may have their surfaces modified by surface functionalization with ionic groups or the like to provide desired interaction in the polymer matrix. Additional optional components may be present in the polymer matrix if desired, such as chain transfer agents, which are typical of free radical polymerizations, to facilitate the polymerization of the monomer or other polymerizable components. Other optional components that may facilitate use in various applications may include colorants, mold-release agents, and other known modifiers. The starting monomer formulation or mixture may also include a crosslinking agent, as for example ethylene glycol dimethacrylate or other difunctional (i.e., diolefinic) monomer or mixture thereof. The polymeric materials may also be thermoset plastics or other suitable epoxy type materials. Epoxy resins useful in the present invention can be monomeric or polymeric, saturated or unsaturated, aliphatic, cycloaliphatic, aromatic or heterocyclic, and they can be substituted if desired with other substituents besides the epoxy groups, e.g., hydroxyl groups, ether radicals, halogen atoms, and the like. Also, as will be described in relation to other embodiments, materials such as silicones may be used to integrate carbon nanostructures therein, such as poly(dimethylsiloxane) or PDMS. Many other suitable polymeric materials are contemplated as will be understood by those skilled in the art.

Figure 6:
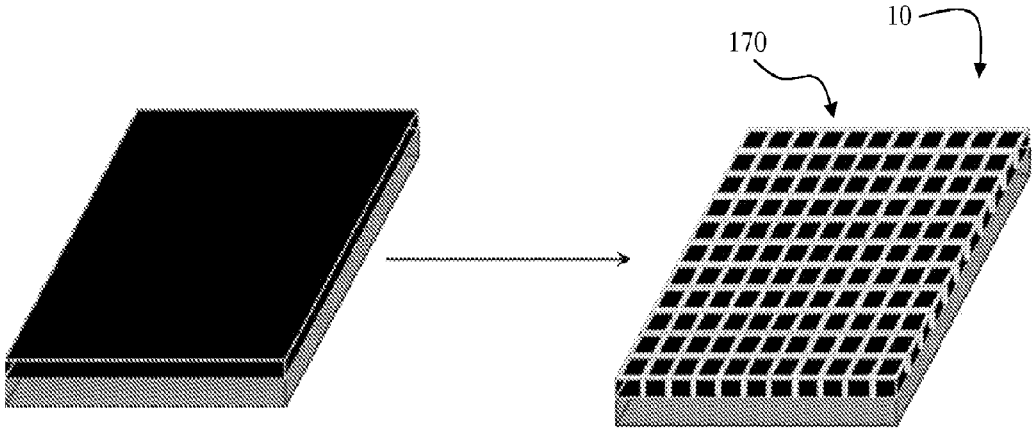
FIG. 6 illustrates a patterned carbon nanotube surface.

With reference to FIG. 6, there is illustrated a patterned carbon nanotube surface 170. A few of the benefits of micro-patterning nanotubes 170 include achieving higher current densities, as opposed to larger patterned nanotubes 170. Patterning increases the number of edges on carbon nanotube films. Having a larger number of edges increases emission density from the edges on the carbon nanotube films. Suitable pattern sizes and shapes may be prepared for any desired application. Spacing between CNT pillars may allow for maximizing the edge effect to increase current density. This could be achieved by reducing the size of the pattern. Increasing the edge and spacing between patterns would reduce the carbon nanotubes density to thereby reduce the effective emission current per unit area. Patterning may be facilitated in a variety of methods, such as depositing a catalyst in a desired pattern using photolithography and then growing carbon nanotubes 100 from the desired patterns. These patterned nanotubes 170 are then transferred onto a polymeric matrix 120 as described above. Another method of patterning includes using soft lithography, wherein stamps, such as poly (dimethyl-siloxane) stamps, are used to deposit a catalyst onto desired regions and wherein the carbon nanotubes 100 grown from those regions are then transferred to the polymeric matrix 120 as described above. Using a soft lithography adhesive substance and then placing it upon a substrate is another method of patterning that creates a desired pattern. The carbon nanotubes 100 can then be transferred to the patterned adhesives. Adhesive films may also be formed on a substrate while certain regions are masked using conducting or insulating ink. Then the carbon nanotubes 100 can be transferred to be partially embedded into the polymer matrix as discussed above.

The processes and methods described above may also be used to change the whole geometry of the field emission device 10, such as making the field emission device 10 flexible or rigid, depending on the type of polymeric material is used. Embodiments of the present invention may include a poly(cyanoacrylate) film on glass that may provide a rigid emission device 10 and a poly(di-methyl-siloxane) (PDMS) elastomer that may provide a flexible emission device 10.

In the case of the poly(cyanoacrylate) embodiment, a thin film of cyanoacrylate monomer coats a glass slide, preferably in a nitrogen environment with little moisture. The film is then left alone for about 10 to 40 seconds so that cyanocrylate polymerizes partially form poly(cyanoacrylate) of a low molecular weight. Carbon nanotubes 100 may be grown on silicon substrate, which is then pressed lightly on the film, such that ends of the carbon nanotubes 100 are partially trapped in the cyanoacrylate. The monomer is then polymerized in presence of moisture from the surrounding air to form a rigid film. The thickness and smoothness of the film can be controlled by spin coating the film in a nitrogen atmosphere. Viscosity of the cyanoacrylate can be controlled by dissolving the cyanoacrylate in a suitable ketone, e.g. acetone.

In the case of the flexible elastomer PDMS film embodiment, a PDMS pre-polymer and a catalyst are thoroughly mixed and a resultant film eased onto a suitable substrate. The film is then kept on a flat surface for about 2 to 4 hours, in order to let the film flow and smoothen the surface. In an example, the film is then heated to approximately 60° C. for about 1 to 2 minutes. At this point, tackiness of the film may be checked. The film should preferably be tacky, but the film should not be a liquid-like consistency. Vertically aligned nanotubes 100 grown on silicon (Si) wafers 110 are then inverted onto a top portion of the partially crosslinked PDMS film. The whole system is then heated up to about 70° C. for about 3 hours. The Si wafer is then peeled off the substrate, leaving aligned nanotubes 100 that are trapped in the PDMS substrate.

Another aspect of the present invention includes electrically connecting aligned nanotubes 100 at one end. The aligned nanotubes 100 have a curvy geometry. Thus, the aligned nanotubes 100 have electrical contact with the neighboring nanotubes 100, which may mean that all the nanotubes 100 are electrically connected. To provide a better electrical connection, a metal was deposited onto an end of the nanotube 100 before transferring the nanotube 100 into a polymer substrate. Additionally, the carbon nanotubes 100 may be grown directly onto metallic surfaces. For example, the vertically aligned nanotubes 100 may be grown on an aluminum substrate. The carbon nanotubes 100 may also be grown on a stainless steel substrate. Thereafter, emission properties may be tested with respect to the emission device 10.

In another embodiment of the present invention, rigid anodes 160 and rigid cathodes 150 may be utilized. The completely rigid system 10 may be synthesized using the rigid cathode 150. For example, carbon nanotubes 100 may be grown on a metallic substrate, e.g. aluminum or stainless steel. The carbon nanotubes 100 may also be grown on a silicon wafer 110 or the carbon nanotubes 100 may be grown on the silicon wafer 110 and the transferred onto a rigid polymeric substrate as described above. A suitable spacer 140, e.g. Teflon spacer, may be used to separate the anode 160 and the cathode 150. A voltage is then applied and an emitted current is then measured. An embodiment of the present invention also includes a rigid anode 160 and a flexible cathode 150. The rigid anode 160 may be a glass such as an indium tin oxide (ITO) coated glass. To create the flexible cathode 150, the carbon nanotubes 100 is transferred into a flexible matrix using the processes as described above. Teflon spacers may also be used. Another spacer 140 that may be used is double sided scotch tape, which may be used to create a space between the anode 160 and the cathode 150.

A completely flexible geometry of an embodiment of the present invention may also be synthesized by having both an anode 160 and a cathode be flexible 150. The flexible cathodes 150 may be prepared by using the processes as described above. The flexible anode 160 may be synthesized by depositing aluminum or another metal onto a flexible matrix using physical vapor deposition process. Indium tin oxide (ITO) may then be deposited onto the flexible matrix. Using a regio-regular poly(3-dodecyloxythiophene-2,5-diyl) (P3DOT), the flexible conductive anode 160 may be created. A thin carbon nanotube mesh is transferred onto a polymeric substrate to create the flexible conductive anodes 160.

Figure 4:
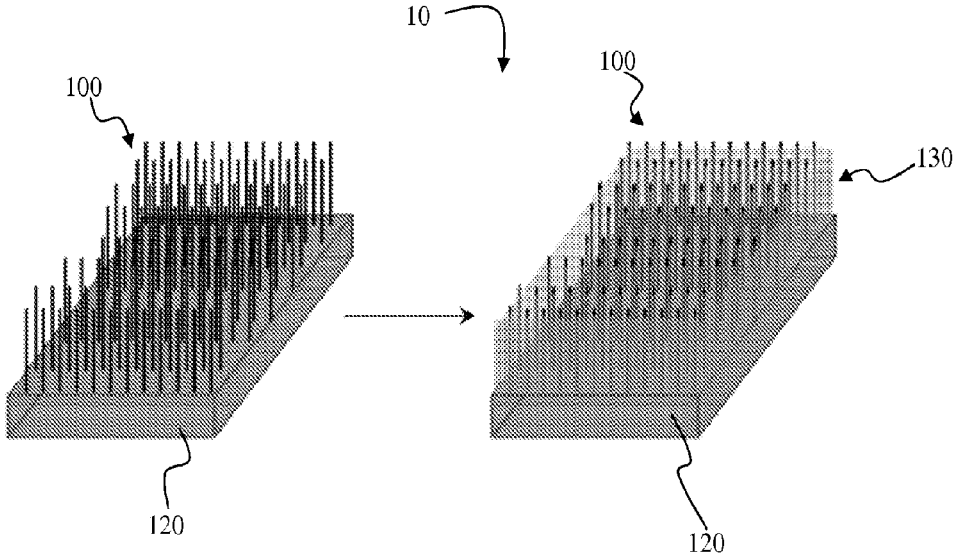
FIG. 4 illustrates how transferring carbon nanotubes onto a polymeric substrate allows for the incorporation of a suitable dielectric material in between the nanotubes without covering the tips of the nanotubes.

With reference to FIG. 4, there is illustrated how transferring carbon nanotubes 100 onto a polymeric substrate 120 may also allow for the incorporation of a suitable dielectric material 130 in between the nanotubes 100 without covering the tips of the nanotubes 100.

Figure 7:
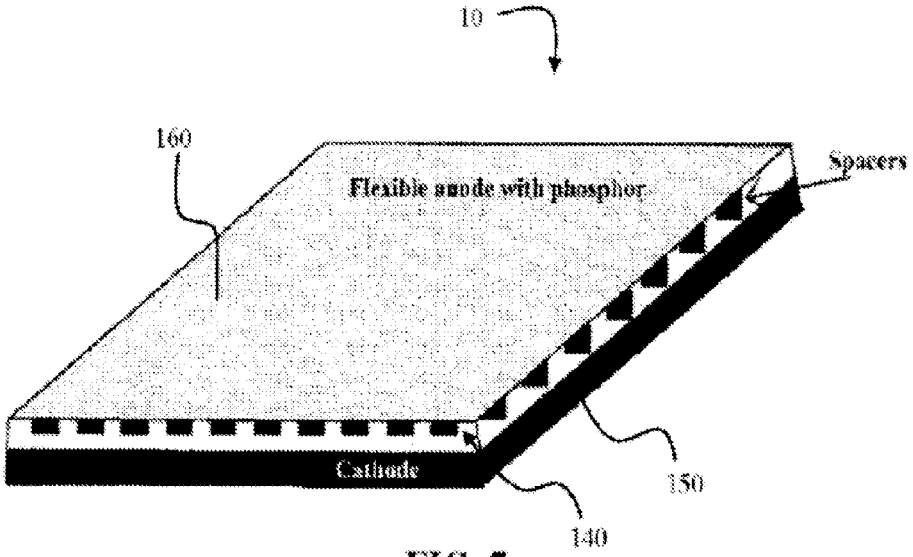
FIG. 7 illustrates a flexible device, wherein the anode and the cathode are constructed on flexible substrates and patterned suitably and the anode and the cathode would then be separated using a sequence of spacers such that the whole geometry is flexible but wherein the region between spacers is rigid enough to prevent short circuiting of the anode and the cathode.

With reference to FIG. 7, there is illustrated a flexible device, wherein an anode 160 and a cathode 150 are constructed on flexible substrates and patterned suitably. The anode 160 and the cathode 150 may then be separated using a sequence of spacers 140 such that the whole geometry is flexible but wherein the region between spacers 140 is rigid enough to prevent short circuiting of the anode 160 and the cathode 150. The flexible geometry spacer 140 may be placed accordingly, preferably between the anode 160 and the cathode 150, so that the anode 160 and the cathode 150 do not short circuit. The spacers 140 may be rigid enough and placed to form a grid in between the anode 160 and the cathode 150 so that a short circuit does not occur.

Figure 8A:
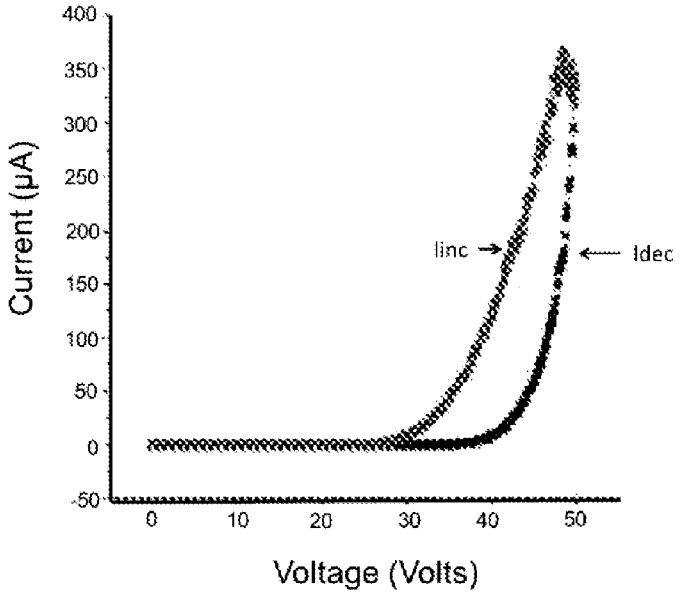
FIG. 8 illustrates (A) a typical Y-I curve for a vertically aligned carbon nanotube sample, (B) plot of In(Ily2) vs. 1/Y, as derived from Fowler-Nordheim equation, wherein the enhancement factor can be derived.
Figure 8B:
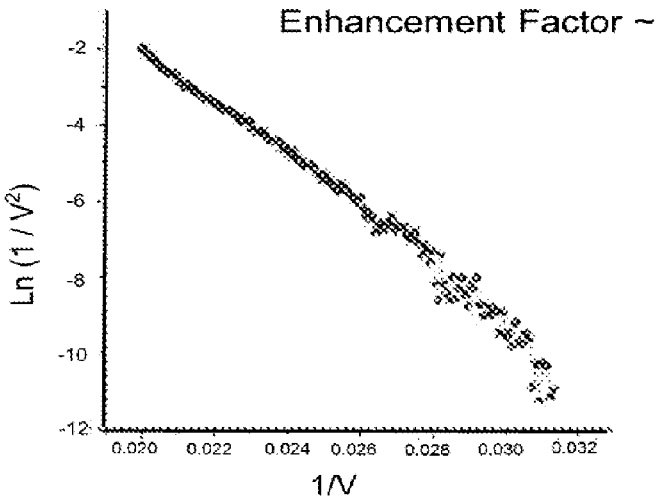
Figure 9:
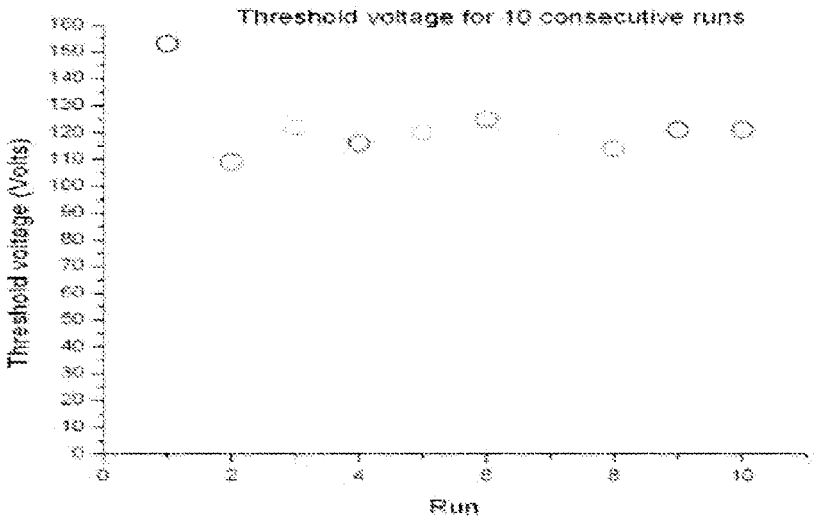
FIG. 9 illustrates a number of threshold voltage measurements.

With reference to FIG. 8, there is illustrated in (A) a typical V-I curve for a vertically aligned carbon nanotube sample, (B) plot of In(IIV2) vs. IN, as derived from FowlerNordheim equation, wherein the enhancement factor can be derived. A curve in FIG. 8(A) illustrates current with increasing voltage, while another curve illustrates a current profile while voltage is being reduced. FIG. 8(B) also demonstrates that an enhancement factor of about 10,000 is obtainable. With reference to FIG. 9, there is illustrated a number of threshold voltage measurements. FIG. 9 illustrates how the threshold voltage remains relatively constant over a number of threshold voltage measurements, which is obtainable with the present invention.

Figure 10:
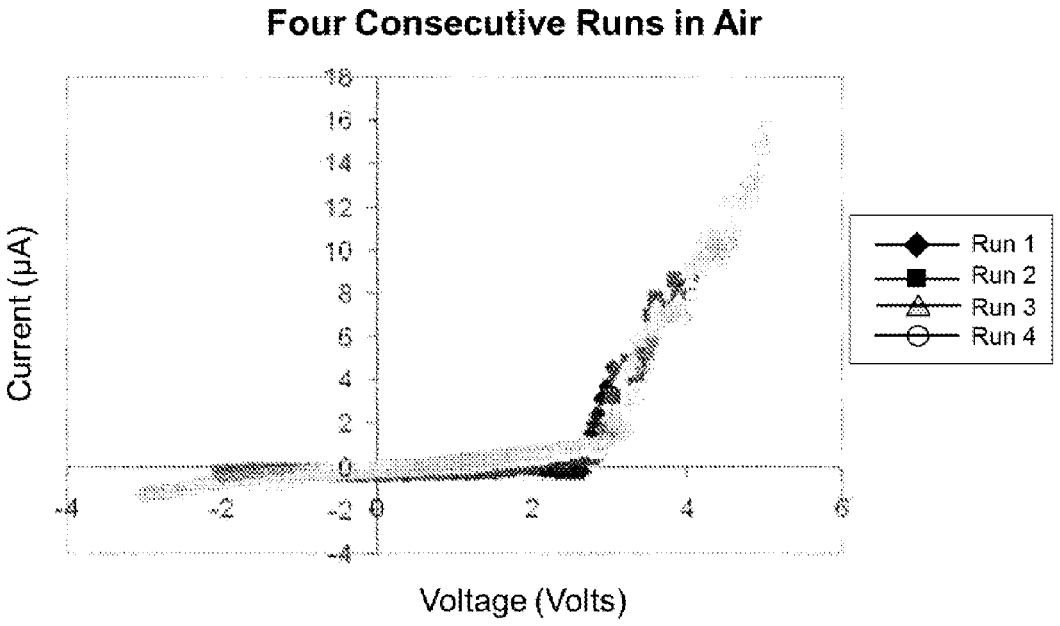
FIG. 10 illustrates the Voltage (Volts) and Current (flA) relationship between four consecutive runs in air.
Figure 11:
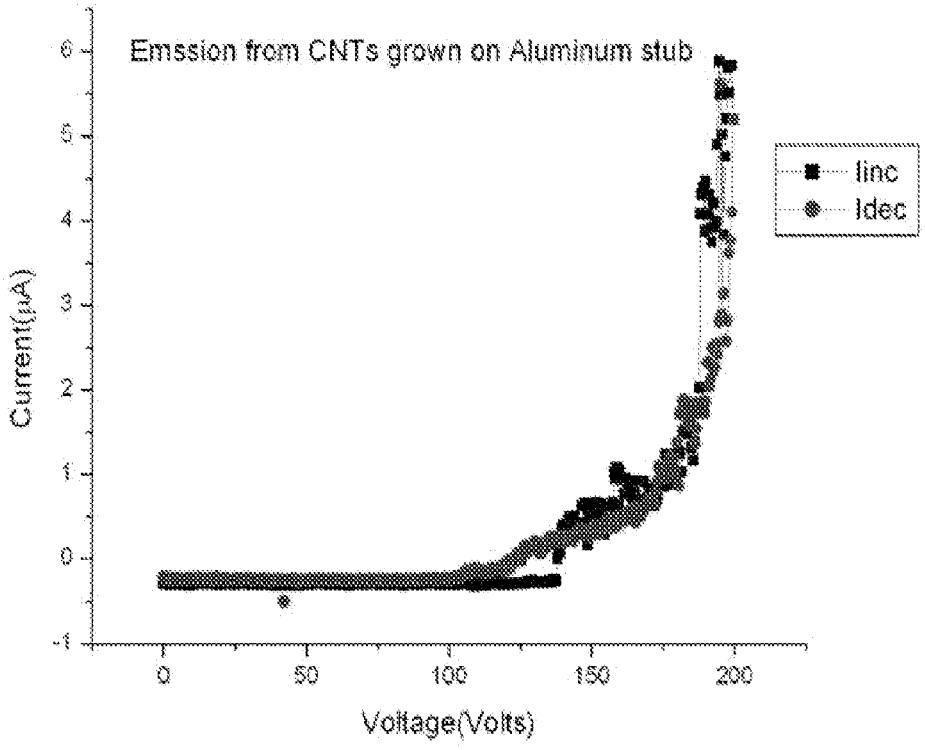
FIG. 11 illustrates errusslOns from carbon nanotubes grown directly on aluminum substrates.
Figure 12:
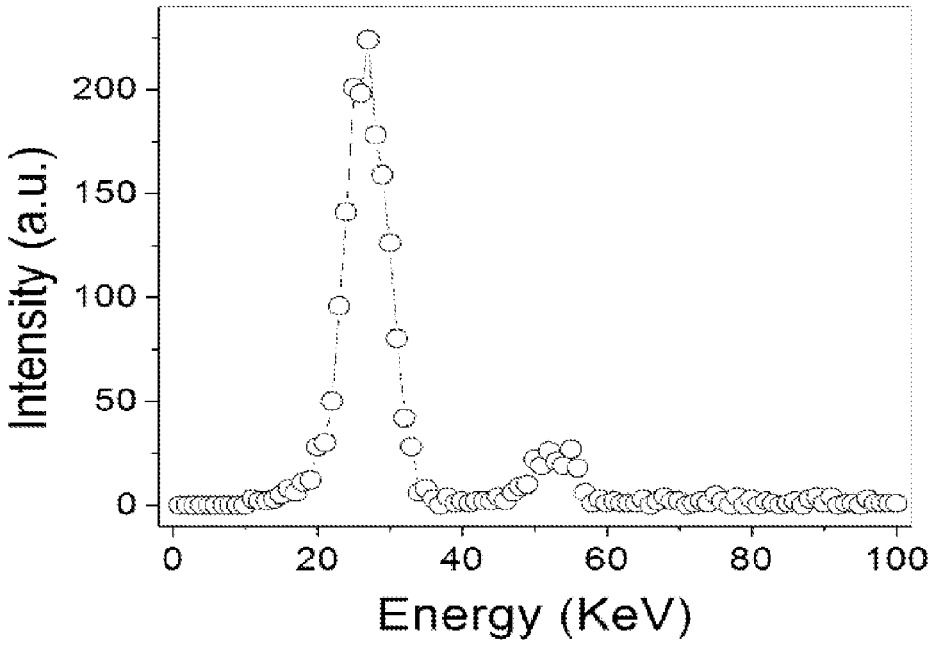
FIG. 12 illustrates an energy dispersive X-ray spectroscopy (EDAX) from carbon nanotubes entrapped in a poly (di methyl siloxane) (PDMS) matrix.

With reference to FIG. 10, there is illustrated the Voltage (Volts) and Current (μA) relationship between four consecutive runs in air. FIG. 10 demonstrates that threshold voltage remains relatively the same for all runs, but that emission current decreases. The decrease in emission current may be due to oxidation of carbon nanotube 100 tips in an oxygen filled environment. With reference to FIG. 11, there is illustrated emissions from carbon nanotubes 100 grown directly on aluminum substrates. With reference to FIG. 12, there is illustrated an energy dispersive X-ray spectroscopy (EDAX) from carbon nanotubes 100 entrapped in a poly(di-methylsiloxane) (PDMS) matrix 120. PDMS is a low energy substrate and tends to coat higher energy surfaces. To transfer the carbon nanotubes structures, a partially crosslinked PDMS film was used. The crosslink density was such that the structure was still tacky but has high enough viscosity to maintain the carbon nanotubes structures. FIG. 12 demonstrates that the PDMS has not contaminated the carbon nanotubes tips.

Figure 13:
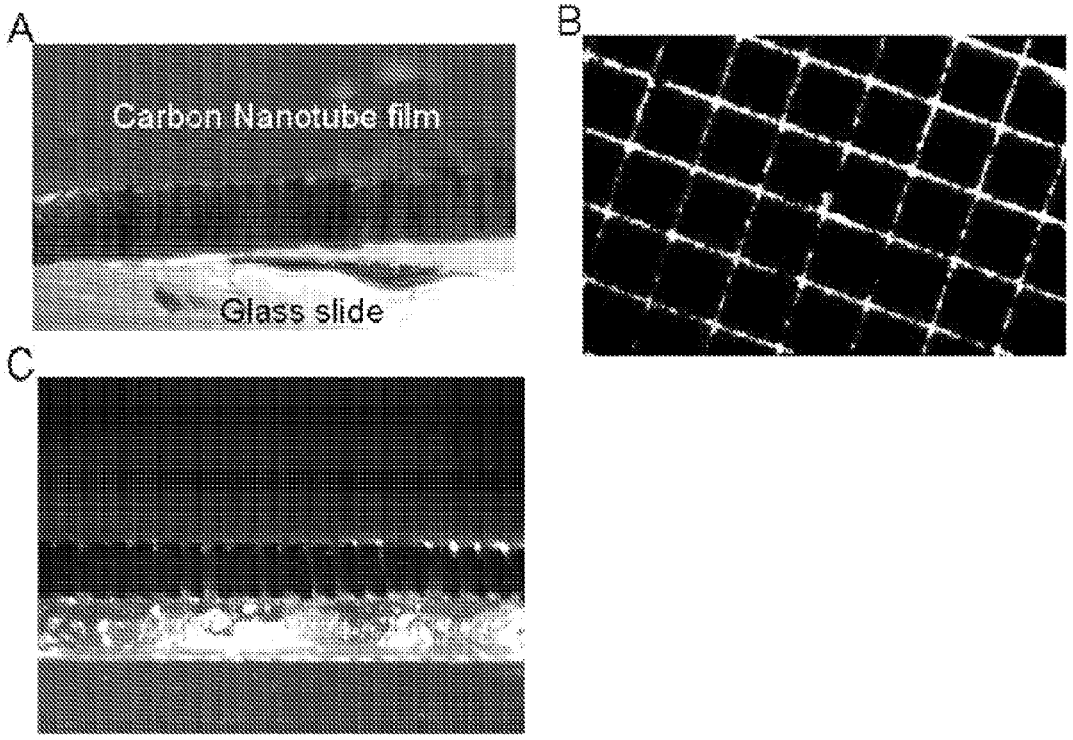
FIG. 13A-13C show photographs of examples according to the invention.

In FIG. 13, there is shown photographs of forming carbon nanotubes arrays in association with a polymer matrix as described. In this example, in FIG. 13A, the carbon nanotubes are transferred on a glass slide using poly(cyanoacrylate). A thin coating of cyanoacrylate is formed on the glass slide. Carbon nanotubes structures grown on Si wafer are then inverted on this coated glass slide. The cyanoacrylate polymerizes in the presence of atmospheric water to form solid poly(cyanoacrylate). The poly(cyanoacrylate) then traps the carbon nanotubes array on the glass slide. FIG. 13B shows micropatterned carbon nanotube arrays embedded in a silver epoxy paste. The micropatterned structures were formed using a photolithography process, with individual patterns sized at 250 flm for example. Silver epoxy was coated on an ITO coated glass slide. The carbon nanotubes were then transferred onto the ITO using a process as described above for example. The process allows an intimate electrical contact of micropatterned carbon nanotubes to be obtained with an underlying electrode. In FIG. 13C, another example shows the macropatterned carbon nanotubes structures were transferred in a rubber. Poly(dimethylsiloxane) (PDMS) was used as backing.

In summary, a method of fabricating a cathodic portion of a field emission display is disclosed. The method of fabricating a cathodic portion of a field emission display includes the steps of producing an array of substantially parallel carbon nanotubes attached at one end to a substantially planar substrate. Then, embedding the nanotubes in a polymer matrix that extends to a plane of attachment of the nanotubes to the planar substrate, wherein the polymer matrix allows an end of the nanotubes distal from the ends attached to the planar substrate, uncovered by the polymer matrix in order to allow electrical contact with each other and with an attached conductor. Next, detaching the array from the planar substrate, thus producing a surface having the formerly attached ends of the nanotubes substantially in a plane, and then attaching the conductor to the array of nanotube ends, uncovered by the polymer matrix and distal to the plane.

The advantages of the process according to the invention as compared to as grown CNT include eliminating the need to grow carbon nanotubes on large areas. As growing uniform carbon nanotubes on large area is challenging, the process overcomes any such limitations. The invention also helps to reduce the screening effect so that emission occurs at lower turn on voltages. Transferring nanotubes in a polymeric matrix helps counteract the surface roughness and yield a more uniform emitting surface. Embedding nanotubes in polymeric matrix facilitates preventing pullout or movement of carbon nanotubes from the base, such as under high electric fields that tend to pull the carbon nanotubes towards the anode, which may lead to short-circuit of the whole geometry. By trapping the carbon nanotubes in a polymeric base, such movement or pull out is avoided. The whole geometry can be made flexible or rigid depending on desired application. The arrangement also facilitates electrically connecting aligned nanotubes at their end. Aligned nanotubes have a curvy geometry thus they have electrical contact with the neighboring tubes. Thus the whole forest is electrically connected. To make a better electrical connection metal was deposited on the ends of nanotube before transferring them into polymer substrate. Carbon nanotubes were also grown directly on metallic surfaces. For example, vertically aligned nanotubes were grown on Aluminum substrate. Carbon nanotubes were also grown on stainless steel substrate and their emission properties tested.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiment disclosed, but that the claimed subject matter will include all embodiments falling within the scope of the appended claims.

What is claimed is:

1. A method of fabricating a cathodic portion of a field emission display comprising the steps of:

producing an array of substantially parallel carbon nanotubes attached at one end to a substantially planar substrate;

embedding said nanotubes in a polymer matrix that extends to a plane of attachment of said nanotubes to said planar substrate, wherein said polymer matrix allows an end of said nanotubes distal from said ends attached to said planar substrate, uncovered by said polymer matrix in order to allow electrical contact with each other and with an attached conductor;

detaching said array from said planar substrate, thus producing a surface having said formerly attached ends of said nanotubes substantially in a plane; and attaching said conductor to said array of nanotube ends, uncovered by said polymer matrix and distal to said plane.

2. The method of claim 1, wherein said field emission display is flexible and wherein said polymer matrix is flowable and is caused to flow into said nanotube array and subsequently cured to a flexible cured matrix.

3. The method of claim 1, wherein said polymer matrix is a polysiloxane.

4. The method of claim 3, wherein said polysiloxane includes a platinum curing catalyst.

5. The method of claim 1, wherein said conductor comprises a metallic coating applied to said array of nanotube ends distal to said plane embedding said nanotubes in a polymer matrix.

6. A field emission device comprising:

a polymer matrix, wherein said polymer matrix is polysiloxane; and two or more carbon nanotubes having a first end and a second end, wherein said two or more carbon nanotubes are substantially parallel to one another, wherein two or more carbon nanotubes are attached to said polymer matrix, and wherein the first ends of said two or more carbon nanotubes are substantially level with one another and the second end of least one of said two or more carbon nanotubes is electrically connected to a conductor.

* * * * *